United States Patent [19]

Alverth et al.

[11] Patent Number: 5,007,890

[45] Date of Patent: Apr. 16, 1991

[54] WEB PLOW FOLDING

[75] Inventors: Ronald W. Alverth, Warrenville; Thomas H. Schumacher, Downers Grove; Thaddeus M. Przybylowski, Worth, all of Ill.

[73] Assignee: WPC Machinery Corporation, Downers Grove, Ill.

[21] Appl. No.: 446,977

[22] Filed: Dec. 6, 1989

Related U.S. Application Data

[63] Continuation of Ser. No. 224,115, Jul. 25, 1988, abandoned.

[51] Int. Cl.[5] ..... B65H 45/16

[52] U.S. Cl. ..... 493/434; 493/439; 493/442; 493/454

[58] Field of Search ..... 493/178, 416, 417, 422, 493/424, 438, 437, 440, 434, 442, 443, 454, 455, 471, 476, 425

[56] References Cited

U.S. PATENT DOCUMENTS 3,147,009 9/1964 Gram .
4,410,390 10/1983 Farrell ..... 493/443
4,419,087 12/1983 Herrington ..... 493/443
4,421,501 12/1983 Scheffer .
4,641,575 2/1987 Cavagna ..... 493/442

*Primary Examiner*—Frederick R. Schmidt
*Assistant Examiner*—Jack Lavinder
*Attorney, Agent, or Firm*—Welsh & Latz, Ltd.

[57] ABSTRACT

A folder plow for a web of material in which the plow is positionable transversely of the longitudinal movement of the web material and has a folding disk rotatable on an axis convergent with the web and being adjustable by tilting about its axis of rotation to position its folding edge at different angles to the plane of the web to obtain a wrinkle free fold without gussetting and to prevent marking. The plow has a cylindrical section rotatable about an axis parallel with the plane of the web, which section is partially telescoped over the disk and provides a shroud for a major section of the disk, the disk having a small sector projecting radially from the contiguous portion of the cylindrical section. The plow is adjustable circumferentially about the axis of rotation of the cylindrical section for advancing or retracting the point of engagement of the disk which has a circumferential frusto-conical edge which merges with an outer face of the disk and forms an apex which engages the web at a series of points.

16 Claims, 3 Drawing Sheets

WEB PLOW FOLDING

This is a continuation, of application Ser. No. 07/224,115, filed Jul. 25, 1988, now abandoned.

BACKGROUND OF THE INVENTION

This invention involves apparatus for folding a continuous length of of web along a longitudinal fold line and more specifically to a folder having novel features which effects folding a continuous length of web material without forming gussets or marking the web or smearing any of the printing of the printing thereon.

Mechanisms for folding a continuous length of web material along a longitudinal fold line as the web moves longitudinally are well known. Such equipment is adapted to fold the paper web material as it is passed to the cutter and sheeter. Conventional apparatus for folding such web material comprises entrance and exit rollers and between these rollers is disposed a folding plow. All of these components are mounted on a frame which may or may not be part of the press.

A particular problem that exists with well known web folders is the formation of wrinkles or gussets at the line of fold and marking of the web in the region of the fold. The problem of web marking is especially significant in web folding equipment employed in the printing industry. However, the problems of wrinkling and gussetting adversely affects the folding of substantially any web material where a sharp crease at the fold line is demanded.

A further problem which occurs in the longitudinal folding of different kinds of web material is the tendency of the folded portion of the web to unfold following the initial folding.

Prior folders have recognized the problem and have attempted to provide a solution by such means as goose neck type arm supported rollers and the like for engaging the folded web generally at the fold line. However, they have been generally found to be unsatisfactory.

SUMMARY OF THE INVENTION

One of the principal objects of the invention is to provide a novel and effective apparatus for folding continuous web material lengthwise thereof which apparatus successfully eliminates wrinkling and/or gussetting of the web material during folding and is adaptable as an adjunct to present day processing apparatus.

Another object is to provide an improved web folding apparatus for use in folding a web material as it is moving longitudinally, which apparatus eliminates marking of the web along the longitudinal fold as has heretofor resulted with prior known apparatus.

A still further object is to provide a new and improved apparatus for folding a web longitudinally as the material is passed from the entrance roller assembly to the exit roller assembly, said apparatus including novel fold forming mechanism which is readily and quickly adjustable so as to co-operate with the entrance and exit rollers to selectively form upwardly or downwardly directed longitudinal folds.

A different object is to provide a folder having a fold forming member which is readily adjustable in certain aspects during the folding operation to substantially eliminate wrinkling or gussetting or marking of the web material so as to obtain a good fold without the need for shutting down the press, and which in other aspects is adjustable to position the folding edges of the folder at different inclinations to the plane of the web.

A primary feature of the invention is to provide a frusto-conical shaped disk-like folding member which is positioned on a mount capable of canting the disk about an axis perpendicular to the axis of the run of the web and thus reposition the point of engagement of the disk with the web and thus optimize the point of turn where the web begins to fold.

A still further feature of the invention is to provide a novel mechanism for tilting the plow disk transversely of its axis of rotation so as to raise or lower the span of web material running on the peripheral apex of the disk, and to provide a series of supporting rollers for the remainder of the web extending laterally from the fold line.

A further object is to provide a folder which comprises a folding plow disk and a support for the web in which all of the web-contacting elements of the plow assembly are rotatable to thus prevent marking or smearing of the printing on the web.

These and other object of the invention will become apparent from the specification and the drawings, wherein.

DESCRIPTION OF THE INVENTION

Figure 1:
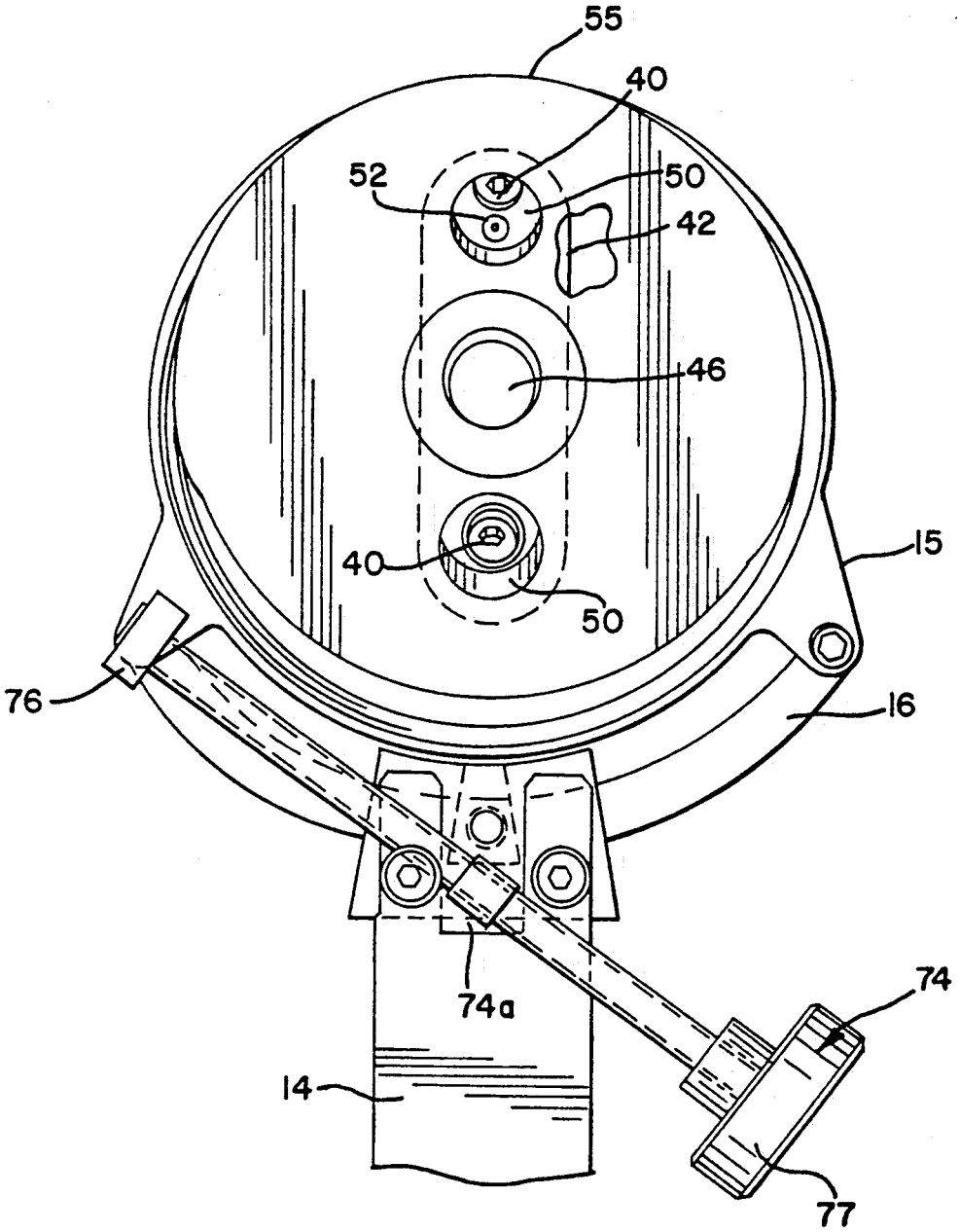
FIG. 1 is one end view of the novel plow mechanism.
Figure 2:
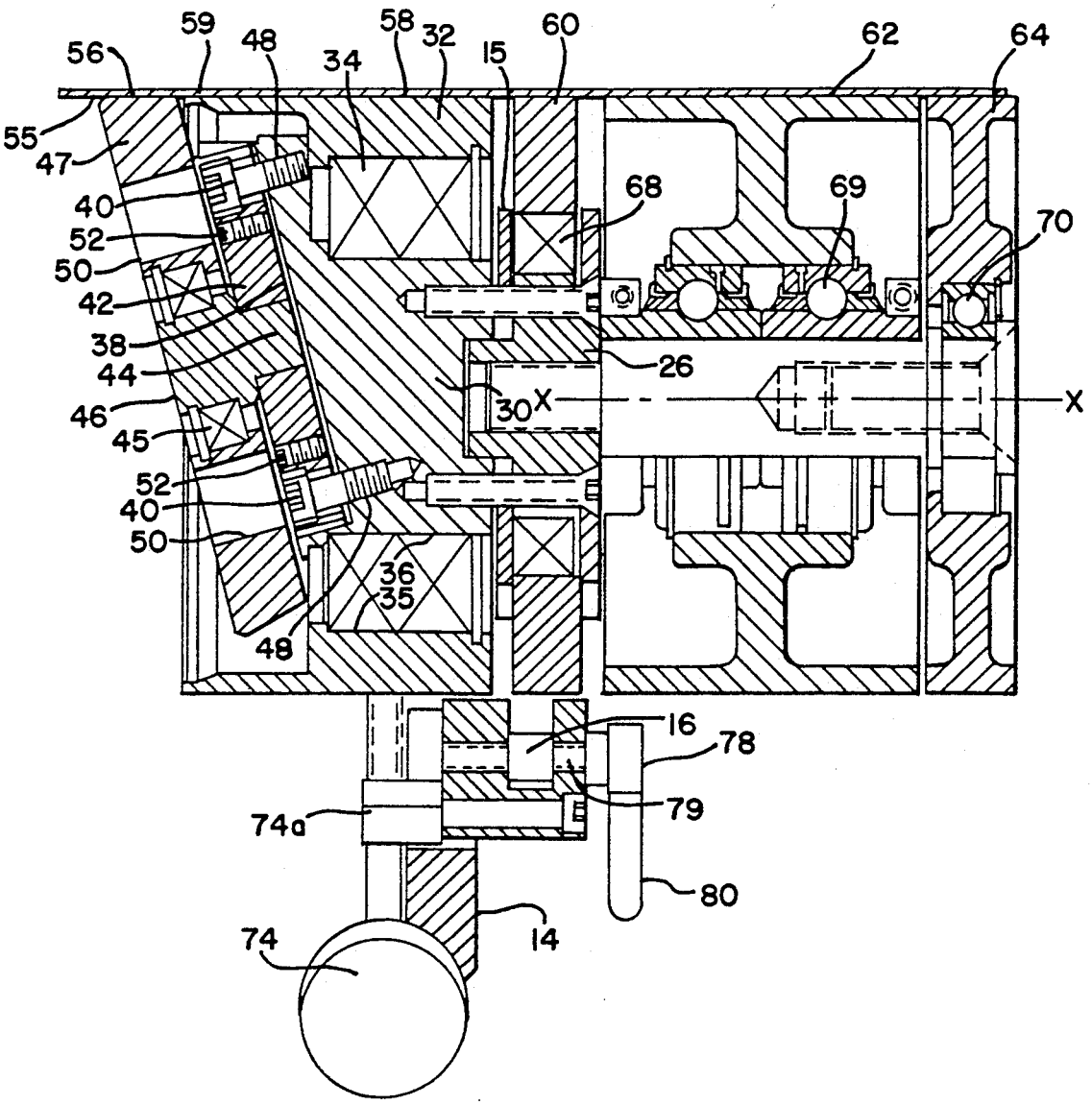
FIG. 2 is a partial longitudinal cross-section taken on line the vertical center plane of FIG. 1.
Figure 3:
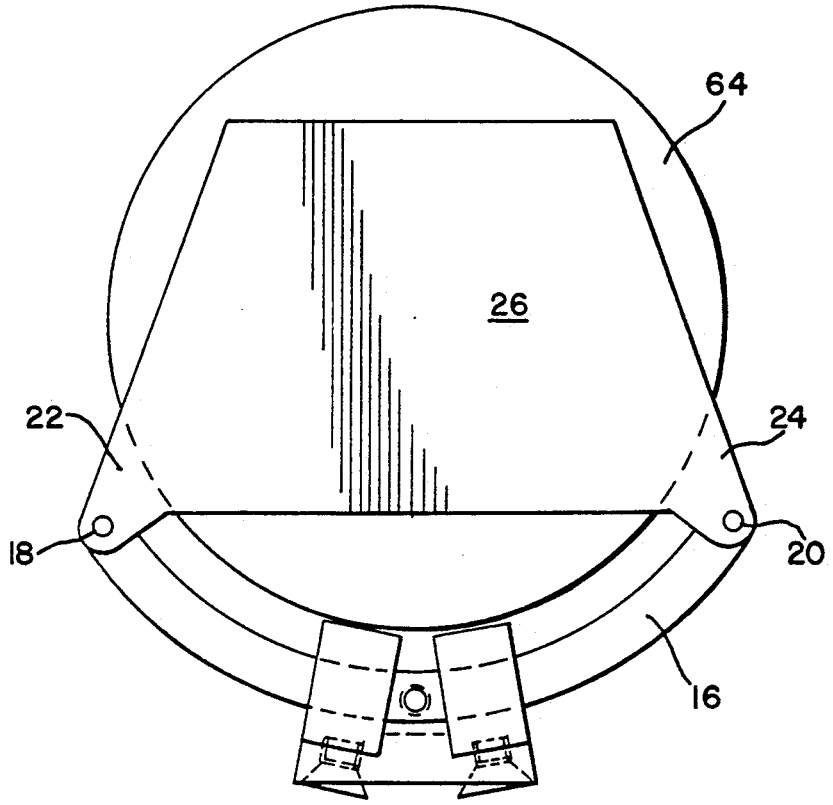
FIG. 3 is the other end view.
Figure 4:
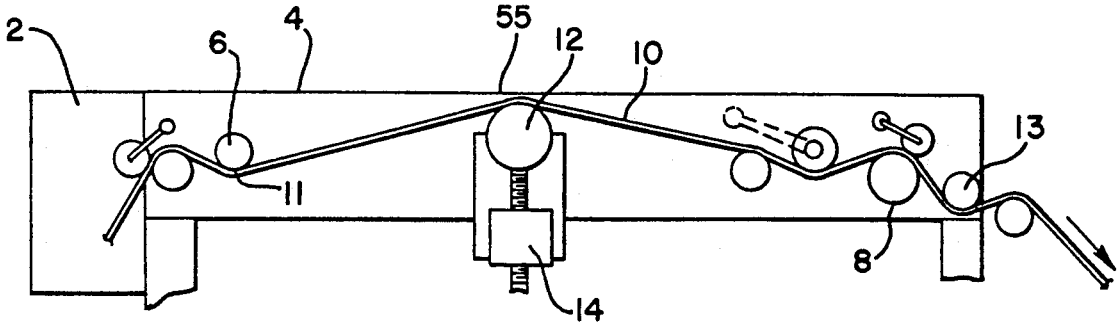
FIG. 4 is a simplified schematic side elevational view illustrating the plow in association with the entrance and exit roller assemblies of a typical press.

Having reference to the drawings, the press generally designated 2 comprises a frame 4 which mounts entrance and exit rollers 6 and 8 extending transverse to an endless web material 10.

The web 10 extends under roller 6 and over folding plow 12 and under roller 8. Take up rollers 11 and 13 associated with rollers 6 and 8 engage the top of the web. Of course, in certain operations the web may extend over roller 6 and under the plow 12 and over roller 8.

The plow apparatus or fold forming assembly 12 comprises a support 14 which at its lower end or otherwise is attached to the frame 4. The upper end of the support 14 carries a clamping assembly 15 which embraces a yoke sector or leg 16 which at opposite ends is secured as at 18 and 20 to circumferentially spaced ears 22,24 of a connector plate assembly 25 which is connected to a hub 26. The hub 26 is connected by bolts to a center core block or carrier 30 which extends axially into a hollow primary roller 32. The carrier or stationary mounting block 30 mounts a bearing assembly 34 which is interposed between an interior bore surface 35 of the primary roller and coaxial bearing surface 36 formed on the core member 30. The axis of rotation of the primary roller 32 is coaxial with the axis of the block 30.

The outer end of the core block or carrier 30 is provided with a slanting surface 38 extending transversely to the axis x–x of the shaft 28 and is connected at a pair of diametrically spaced points by bolts 40,40 to an adjustable elongated key 42 against the inclined face 38. The key is connected intermediate its ends to one end 44 of the stationary means or stub shaft 46 which at its other end journals via bearings 45 a plow disk element or fold forming member 47 of frusto-conical shape partially within an annular hollow extension of the outer end portion of the primary roller 32.

The disk has an outer circular face 49 and is provided with a pair of access openings 50,50 which are diametrically opposed and alignable with respective bolts 40,40 for admitting a bolt tool therethrough for loosening or tightening the bolts 40,40 and a pair of set screws 52,52 which are positioned adjacent respective bolts 40,40. The set screws are threaded through the key and react against the block 30. By threading one set screw in and unthreading the other set screw out, various angle relationships between the block and the plow disk or fold forming member 47 may be obtained. If the disk 47 must be moved transaxially of the shaft, the bolts 40,40 being loose and extending through slots 48,48 elongated diametrically in the key, permits shifting of the disk transversely of the stationary stub shaft 46. After adjustment, the bolts 40,40 are tightened. Thus the disk 47 is adjustable about the axis of shaft 46 in two ways. It may be or tilted and also it may be shifted edgewise to obtain the proper contact point of turn indicated at 55 of the plow defined by the edge of the frusto-conical disk at 56 and the end portion or circular face 49 thereof. The adjustment of this contact point and the area of engagement by the web on the web-contacting peripheral annular surface 57 of the frusto-conical plow disk fold forming member 47 and the web-engaging surface 58 of the primary roller 32 will determine the angular disposition of the section 59 of the web between point 55 and surface 58. Depending on the width of the web, it may extend laterally over the one secondary roller 60 and back up rollers 62,64, all coaxially mounted on the shafts 26 and 26' by bearings 68, 69 and 70 respectively.

The circumferential adjustment of the mechanism about the axis of the block 30 is accomplished by an adjusting screw 74 which is threaded through a reaction threaded block **74*a* which is pivotally mounted to the framework on an axis parallel with the axis x—x. One end of the screw 74 is connected to a swivel 76 connected to one end of the sector or yoke 16. The other end of the screw 74 is provided with a knob 77** for turning the screw and thus rotate the plow assembly into about the axis x—x.

A set lock 78 is provided with a screw 79 threaded through the mounting support and having its inner end abuttable with one side of the yoke 16 and is provided at its outer end with a handle 80 such that turning the handle will lock the yoke 16 to the support and turning the handle the other way unlocks the yoke so that the entire assembly may be adjusted circumferentially and the point of contact of the disk is advanced or retracted with respect to the entry roller.

It has been found that the adjustment of the tilt of the plow disk has eliminated the gussetting and wrinkling problems and the marking of the web. The repositioning of the turning point has also been useful in this respect.

We claim:

1. Apparatus for folding an elongated flexible web material having a path of travel there-through generally in the lengthwise direction of the apparatus, the web having a width that includes a main unfolded portion and a folded side portion after having passed through the apparatus, said apparatus comprising:

a frame, entrance and exit rollers supported from said frame transversely of said path, a plow folder assembly supported on the frame intermediate of said entrance and exit rollers and cooperative therewith to effect longitudinal folding of one side portion of said web material as it is moved along said lengthwise path from said entrance to said exit rollers, said plow folder assembly being in contact with the web material at an elevation that is generally different from the elevation of said entrance and exit rollers, said plow folder assembly comprising:

a support means for attaching said plow folder assembly to said frame;

a generally hollow cylindrical roller means having an axis of rotation and being supported for rotation by said support means, said cylindrical roller means extending transversely relative to the lengthwise direction of the apparatus, the roller means presenting an arcuate portion of its periphery which provides a support surface for the main unfolded portion of the web material, said roller means having a predetermined diameter and having a hollow recess for receiving a portion of a rotatable plow folder member;

a plow folder means being attached to said support means adjacent said cylindrical roller means, said plow folder means having a frusto-conical peripheral outer portion rotatable about an axis of rotation and said outer portion having an outer diameter smaller than the inside diameter of said recess of said cylindrical roller means so that said plow folder means at least partially fits within said recess of said cylindrical roller means, said frusto-conical peripheral outer portion being adapted to contact the web material along an arcuate angle and provide a relatively sharp edge for initiating the formation of a fold in the web material, said plow folder means being oriented relative to said cylindrical roller means such that the portion of said frusto-conical peripheral outer surface along said arcuate angle which is adapted to contact the web material is generally coextensive with the outer surface of said arcuate portion of the periphery of said cylindrical roller means so as to present a substantially uninterrupted support for the web material;

means for adjusting the angular orientation of said plow folder means generally around the axis of rotation of said cylindrical roller means to thereby adjust the angular orientation of said arcuate angle of said plow folder means and of said cylindrical roller means which contacts the web material.

2. Apparatus as defined in claim 1 wherein said support means further comprises:

a block means located on the interior of said cylindrical roller means and having a bearing means adapted to permit rotation of said cylindrical roller means relative to said block means;

a hub means attached to said block means and extending away from the arcuate portion of the periphery of said cylindrical roller means which provides the support surface for the main unfolded portion of the web material beyond the periphery of said cylindrical roller means;

said adjusting means interconnecting said hub means and said frame in a manner whereby the angular position of said hub relative to said axis of rotation of said cylindrical roller means can be changed during operation of said apparatus.

3. Apparatus as defined in claim 2 wherein said adjusting means includes a knob that is rotatable for causing said adjusting means to change the angular position of said hub upon such rotation, said knob being capable of rotation during operation of said apparatus.

4. Apparatus as defined in claim 2 wherein said plow folder means further comprises an inner nonrotatable shaft means and bearing means mounted to said shaft means, said bearing means carrying said outer portion, said shaft means including mounting means for mounting the same to said block means, said mounting means being adapted to change the angular orientation of the axis of rotation of said outer portion of said plow folder means relative to the axis of rotation of said cylindrical roller means, and also being adapted to change the distance between adjacent portions of said cylindrical roller means and said outer portion of said plow folder means.

5. Apparatus as defined in claim 4 wherein said shaft means comprises a stub shaft and an elongated key, said stub shaft being connected to said key, said bearing means being mounted to said stub shaft.

6. Apparatus as defined in claim 5 wherein said mounting means comprises bolts threadably connecting said elongated key with said block means, and set screws threaded through said elongated key to vary the disposition of said plow folder means on said stub shaft by adjustment of said bolts and set screws.

7. Apparatus as defined in claim 6 wherein said elongated key contains slots which are diametrically opposed with reference to the axis of the stub shaft to accommodate shifting of said plow folder means in the lengthwise direction of said apparatus.

8. Apparatus as defined in claim 1 further including a secondary roller means located adjacent said hub means and near said cylindrical roller means, said secondary roller means having an outer diameter substantially the same size as said cylindrical roller means, the combination of said secondary roller means and said cylindrical roller means providing a support surface for a substantial portion of said main unfolded portion of the web material.

9. A plow folder apparatus, suitable for use in folding a flexible web material as it is moved in a substantially longitudinal direction through the apparatus, the apparatus comprising:

frame means;

entrance roller means mounted to said frame means in the upstream portion of said apparatus, and being adapted to position the web material at a predetermined elevation;

exit roller means mounted to said frame means in the downstream portion of said apparatus, and being adapted to position the web material at a predetermined elevation;

plow folding means mounted to said frame means between said entrance roller means and said exit roller means at an elevation different from said entrance roller means and exit roller means, said plow folding means comprising:

support means mounted to said frame means, said support means supporting a plow disk element and a cylindrical roller means for rotation, and being adapted to permit adjustment of the angular orientation of an arcuate angle defined by the portion of said plow disk element and said cylindrical roller that is in contact with the web material, said adjustment being generally around said axis of rotation of said cylindrical roller means;

a generally hollow rotatable cylindrical roller means disposed generally normal to the longitudinal direction of the apparatus and being adapted to engage the web material through an arcuate angle of the surface of said cylindrical roller means;

a plow disk element mounted on said support means for rotation about an axis of rotation and located adjacent said cylindrical roller means, said plow disk element having a frusto-conical outer surface and a relatively sharp edge on the side opposite said cylindrical roller means over which the web material is folded by engaging the web material through an arcuate angle that is substantially the same as the orientation and angle as the arcuate angle of said rotatable cylindrical roller means which engages the web material, said plow disk element axis of rotation being oriented at an angle relative to the axis of rotation of said cylindrical roller means such that said frusto-conical surface of said plow disk element is generally coextensive with the outer surface of said cylindrical roller means through said arcuate angle; and, means for angularly adjusting said plow disk element and said cylindrical roller means around said axis of rotation of said cylindrical roller means.

10. Apparatus as defined in claim 9 wherein said support means further comprises a block means located on the interior of said cylindrical roller means and having a bearing means adapted to permit rotation of said cylindrical roller means relative to said block means;

a hub means attached to said block means and extending away from the arcuate portion of the periphery of said cylindrical roller means which provides the support surface for the main unfolded portion of the web material beyond the periphery of said cylindrical roller means;

said adjusting means interconnecting said hub means and said frame in a manner whereby the angular position of said hub relative to said axis of rotation of said cylindrical roller means can be changed during operation of said apparatus.

11. Apparatus as defined in claim 10 wherein said adjusting means includes a knob that is rotatable for causing said adjusting means to change the angular position of said hub upon such rotation, said knob being capable of rotation during operation of said apparatus.

12. Apparatus as defined in claim 10 wherein said plow disk element further comprises an inner nonrotatable shaft means and bearing means mounted to said shaft means, said bearing means carrying said outer portion, said shaft means including mounting means for mounting the same to said block means, said mounting means being adapted to change the angular orientation of the axis of rotation of said outer portion of said plow disk element and the axis of rotation of said cylindrical roller means, and also being adapted to change the distance between adjacent portions of said cylindrical roller means and said outer portion of said plow disk element.

13. Apparatus as defined in claim 12 wherein said shaft means comprises a stub shaft and an elongated key, said stub shaft being connected to said key, said bearing means being mounted to said stub shaft.

14. Apparatus as defined in claim 13 wherein said mounting means comprises bolts threadably connecting said elongated key with said block means, and set screws threaded through said elongated key to vary the disposition of said plow disk element on said stub shaft by adjustment of said bolts and set screws.

15. Apparatus as defined in claim 14 wherein said elongated key contains slots which are diametrically opposed with reference to the axis of the stub shaft to accommodate shifting of said plow disk element in the lengthwise direction of said apparatus.

16. Apparatus as defined in claim 9 further including a secondary roller means located adjacent said hub means and near said cylindrical roller means, said secondary roller means having an outer diameter substantially the same size as said cylindrical roller means, the combination of said secondary roller means and said cylindrical roller means providing a support surface for a substantial portion of said main unfolded portion of the web material.

* * * * *

UNITED STATES PATENT AND TRADEMARK OFFICE

CERTIFICATE OF CORRECTION

PATENT NO. : 5,007,890

DATED : April 16, 1991

INVENTOR(S) : Alverth et al.

It is certified that error appears in the above-identified patent and that said Letters Patent is hereby corrected as shown below:

Column 2, line 27, delete "line".

Column 3, line 19, after "be" insert --canted--.

Signed and Sealed this

First Day of December, 1992

*Attest:*

DOUGLAS B. COMER

*Attesting Officer*

*Acting Commissioner of Patents and Trademarks*